US010465389B2

(12) United States Patent
Hughes

(10) Patent No.: US 10,465,389 B2
(45) Date of Patent: Nov. 5, 2019

(54) PERGOLA ROOF SUPPORT ATTACHMENT

(71) Applicant: Curtis Hughes, Argyle, TX (US)

(72) Inventor: Curtis Hughes, Argyle, TX (US)

( * ) Notice: Subject to any disclaimer, the term of this patent is extended or adjusted under 35 U.S.C. 154(b) by 0 days.

(21) Appl. No.: 16/139,416

(22) Filed: Sep. 24, 2018

(65) Prior Publication Data

US 2019/0093366 A1 Mar. 28, 2019

Related U.S. Application Data

(60) Provisional application No. 62/562,949, filed on Sep. 25, 2017.

(51) Int. Cl.

| | |
|---|---|
| ***E04F 10/08*** | (2006.01) |
| ***E04C 3/02*** | (2006.01) |
| ***E04C 3/04*** | (2006.01) |
| ***E04C 3/06*** | (2006.01) |

(52) U.S. Cl.

CPC ..... *E04F 10/08* (2013.01); *E04C 3/06* (2013.01); *E04C 2003/026* (2013.01); *E04C 2003/046* (2013.01)

(58) Field of Classification Search

CPC ..... E04F 10/08; E04C 3/06; E04C 2003/026; E04C 2003/046

See application file for complete search history.

(56) References Cited

U.S. PATENT DOCUMENTS

| | | | | |
|---|---|---|---|---|
| 2,497,337 | A * | 2/1950 | Ackerman | E04F 10/08 16/259 |
| 5,603,187 | A * | 2/1997 | Merrin | E04D 13/12 52/58 |
| 5,975,471 | A * | 11/1999 | Dishman | E04B 7/02 182/45 |
| 9,822,524 | B1 * | 11/2017 | Meznarich | H02S 20/23 |
| 10,132,074 | B2 * | 11/2018 | Pace | E04H 6/025 |
| 2007/0000200 | A1 * | 1/2007 | Fairbairn | E04F 10/08 52/473 |
| 2008/0121273 | A1 * | 5/2008 | Plaisted | F16L 3/127 136/251 |
| 2011/0289878 | A1 * | 12/2011 | Morey | E04C 3/02 52/653.2 |
| 2016/0040430 | A1 * | 2/2016 | Lethin | E04D 3/3608 52/58 |
| 2018/0112391 | A1 * | 4/2018 | Pace | E04H 6/025 |
| 2018/0340336 | A1 * | 11/2018 | Fischer | E04D 13/147 |

FOREIGN PATENT DOCUMENTS

| | | | | |
|---|---|---|---|---|
| WO | WO-9704189 | A1 * | 2/1997 | E04B 7/02 |

* cited by examiner

*Primary Examiner* — Rodney Mintz
(74) *Attorney, Agent, or Firm* — Braxton Perrone, PLLC

(57) ABSTRACT

A roof structure support allowing roof shingle having a partially tubular mounting bracket having an upper plate for securing a roof structure joist and a lower plate for securing onto a wall plate, wherein a base tube is received by a collar affixed to a roofing deck and an associated boot.

17 Claims, 6 Drawing Sheets

PERGOLA ROOF SUPPORT ATTACHMENT

CLAIM OF PRIORITY

This Application claims priority to Provisional Patent Application No. 62/562,949 filed Sep. 25, 2017, which is incorporated herein in its entirety by reference.

BACKGROUND OF THE INVENTION

The present disclosure is directed to an apparatus for attachment of a structure to a roof that bears the load of the structure while allowing roof shingle and subsurface replacement without removal or damaging tear down of the structure. In one embodiment, the system disclosed is a partially tubular mounting bracket to which rafters of a structure such as a pergola may be attached to a roof. The mounting bracket disclosed herein allows for replacement of roof shingles or sub-roofing without detachment or even temporary removal of pergola rafters from the roof, which are traditionally rigidly fixed to the roof directly with nails or screws. Under traditional methods of attaching pergola rafters to a roof, removal of the rafters often causes damage to the rafters and the overall structure of the pergola, causing its replacement.

Current outdoor structures attached to a roof of a house or building for support, such as pergolas, are attached to the subsurface of the roof, which is plywood. Usually, the pergola is attached to the plywood through the shingles directly with nails or screws. This means that the end of a pergola rafter is in direct contact with the roof shingles when attached to the roof's plywood subsurface. Such direct attachment of the pergola rafters to the roof is not structurally sound support, is not sufficient positive anchoring to prevent uplift and is conducive to roof leaks. The only parts of the home or building structure adequate to carry the load of a structure such as a pergola is a rafter or wall.

BRIEF DESCRIPTION OF THE DRAWINGS

The invention and a preferred mode of use, further objectives and advantages thereof, will be best understood by reference to the following detailed description of illustrative embodiments when read in conjunction with the accompanying drawings, wherein.

DETAILED DESCRIPTION

Several embodiments of the invention will now be described with reference to the drawings. Unless otherwise noted, like elements will be identified by identical numbers throughout all figures. The invention illustratively disclosed herein suitably may be practiced in the absence of any element which is not specifically disclosed herein.

The pergola support device described herein places the load directly on the house beam or wall header or cap to which it is attached. The support device supports the structure's weight and secures the structure (such as a pergola) in a manner that resists uplift. The interface between the roof shingles and the support device is waterproof as the pergola rafters no longer come in direct contact with roof shingles and roof shingles and the roof subsurface are no longer compromised with securing screws or nails.

Installation of the presently described pergola support is fast and simple and requires no demolition or shingle replacement. Some community home owner's association (HOA) bylaws, property restrictive covenants or local ordinances prevent pergola attachment directly to the roof of a home because of the issues created as described above.

Figure 1:
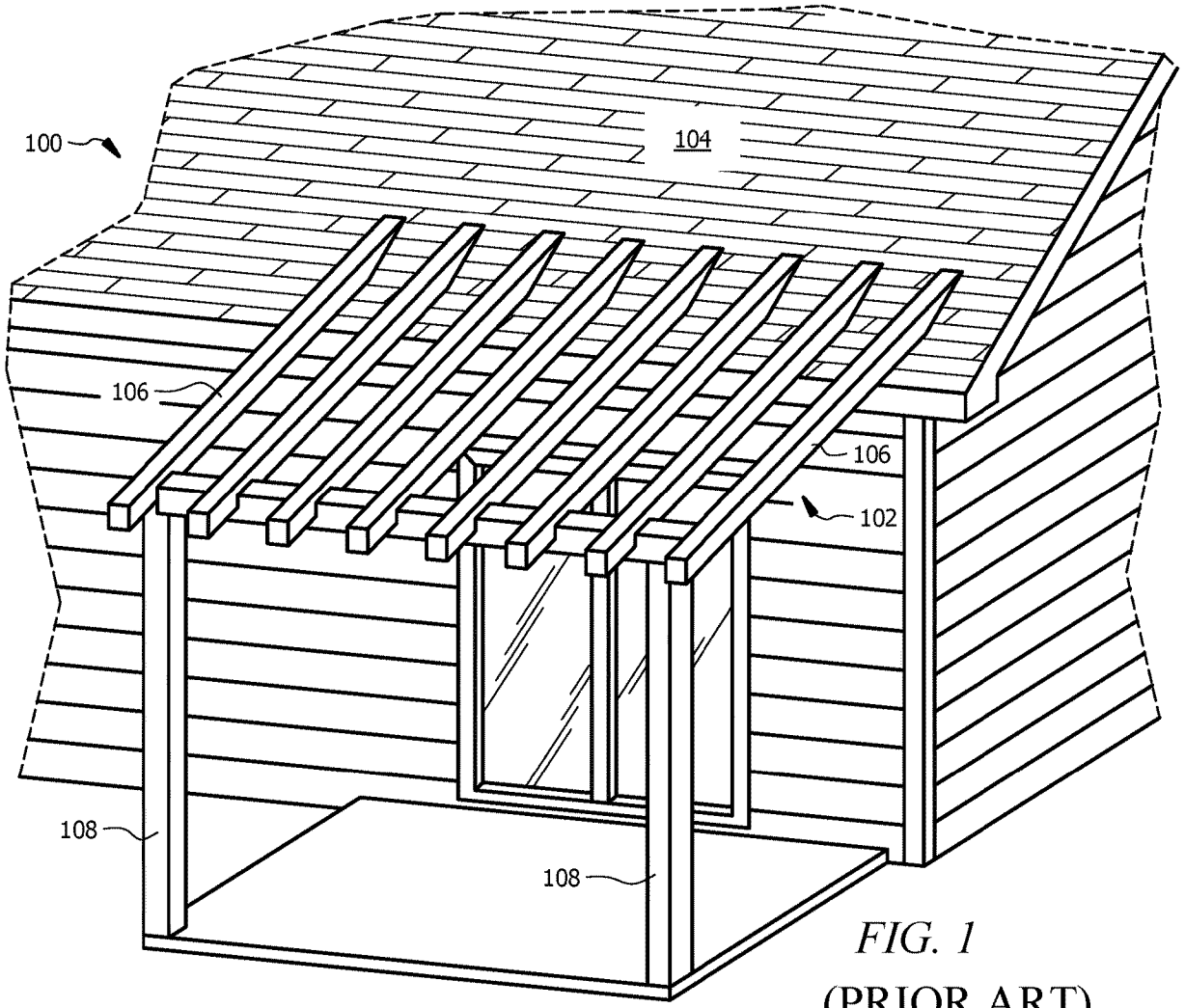
FIG. 1 (PRIOR ART)
FIG. 1 is a perspective view of a pergola structure attached to the roof of a home.
Figure 2:
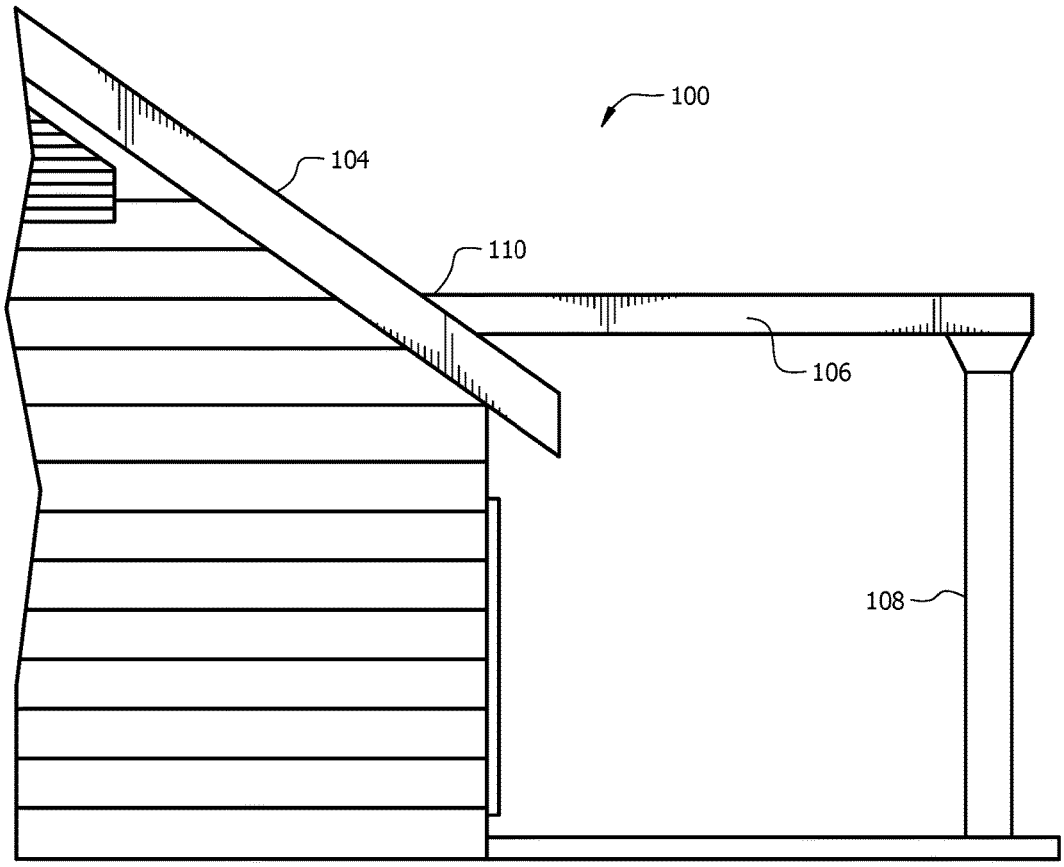
FIG. 2 (PRIOR ART)
FIG. 2 is a side view of a pergola structure attached to a house roof.

FIG. 1 depicts a pergola structure attached to the roof of a home in the traditional manner. In FIG. 1 house 100 has attached to it pergola 102. Pergola 102 typically comprises a plurality of elongated rafters 106 that run parallel to each other. The load of each rafter 106 of pergola 102 is supported on one end by roof 104 and on the other end by post 108. As shown in FIG. 2, which is a side view, each rafter 106 joins roof 104 at a junction point 110. In this manner, rafter 106 is in direct contact with shingles on roof 104 when the roof end of rafter 106 is fastened to the subsurface of roof 104, which is usually plywood, by screws, nails or the like. As discussed above, such attaching procedures and arrangements are undesirable. First, the plywood area of the pitched roof is inadequate to bear the load of the pergola. Second, the fastening of the roof end of the pergola rafters 106 to the plywood sub-roof material is of inadequate strength to prevent updrafts that cause the pergola to tear away from the roof. Third, the penetration of shingles to fasten the pergola rafters 106 to the roof sub-surface compromises the shingles, leaving them prone to leaks. Finally, in the event that roof shingles or sub-surface needs replacing, which is very common in regions susceptible to hail storms where roof replacement is often necessary long before the end of the roof's useful life, the pergola rafters need to be removed from the roof in order to replace the roof. This results in damage or destruction of the pergola altogether, often necessitating full replacement of the pergola in addition to the roof. Moreover, pergola removal independent of roof replacement is problematic because removing fastened pergola rafters from an otherwise fine roof can damage the roof's shingles and/or sub-surface.

Figure 3:
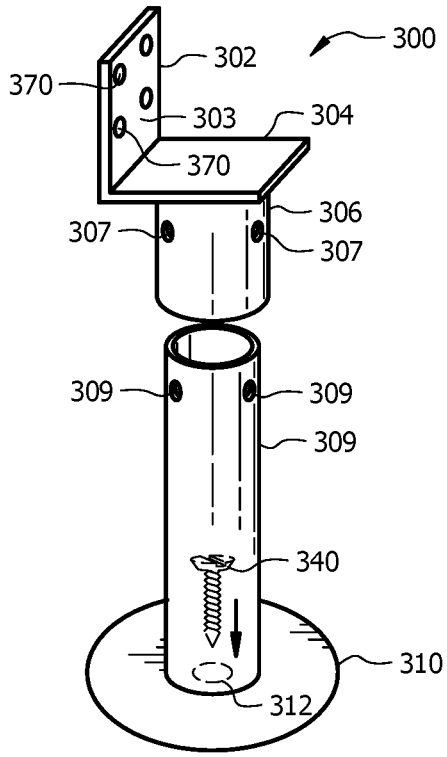
FIG. 3 is a perspective view of a pergola support according to an embodiment of the present disclosure.

The presently described pergola support attachment resolves the shortcomings of traditional methods and means for attaching a pergola to a roof. An embodiment of the pergola support attachment is depicted in FIG. 3. In FIG. 3 pergola support attachment 300 comprises an L-shaped angle plate 302 having a horizontal base 304. Angle plate 302 includes a vertical face 303 having one or more holes 370 for securing a header beam as later described. Angle plate 302 can be manufactured in a variety of sizes and in one embodiment is 4 inch×4 inch×6 inch in size with 3/16 inch thickness and can be manufactured of a variety of metals or alloys. Horizontal base 304 can be attached via welding to an upper side of tubular sleeve 306. Tubular sleeve 306 can include one or more pairs of holes 307 for receiving a bolt to be secured by a nut. Tubular sleeve 306 in one embodiment is cylindrical in shape and has a 2.5 inch outer diameter and the cylindrical wall is 3/16 inch thick and is 3 inches in length. Tubular sleeve 306 and angle plate 302 can be manufactured at various sizes according to a particular application.

Pergola support attachment includes base tube 308. At the upper end of base tube 308 can be a pair of aligned holes 309, which align with holes 307 of tubular sleeve 306. Holes 307 and 309 correspond as such when tubular sleeve 306 is slidably engaged with upper end of base tube 308, allowing insertion of a bolt secured by a nut through both sets of holes in order to secure tubular sleeve 306 to the upper end of base tube 308. Base tube 308 in one embodiment has an outer diameter of 2.0 inches, is 3/16 inches thick and has a height of 12 inches. Base tube 308 can be manufactured in sizes according to a particular application. The diameters of tubular sleeve 306 and base tube 308 should be sized, however, for sleeve 306 to receive the upper end of base tube 308 or for base tube 308 to receive tubular sleeve 306. The lower end of base tube 308 is connected to base plate 310 via welding or other appropriate fastening means. Base plate 310 can be square, rectangular, circular or of any shape that provides a secure interface to the wall top plate or porch beam to which it is fastened. In one embodiment, base plate 310 can circular and be 3½ inches in diameter, and of 3/16 inch thickness, to pass through a 4 inch hole cut from the roof. Base plate 310 also can have a hole 312 drilled in its center and a lag bolt 340 welded to the plate for securing into the wall or beam 332 as described below with respect to FIG. 4. In the alternative, base plate 310 can be a 4 inch square plate of 3/16 inch thickness, with a center hole and as associated lag bolt inserted and welded to the base plate securing base tube 308 and base plate 310 to wall top plate or porch beam header with a lag bolt or the like. The hole cut in the roof must correspond to these alternatively shaped base plates.

Figure 4:
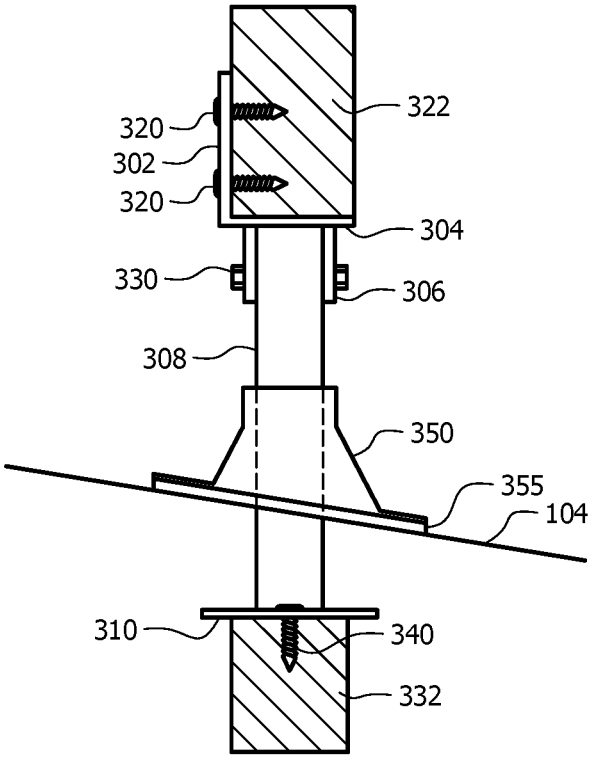
FIG. 4 is a side view of an installed pergola support according to an embodiment of the present disclosure.

An installed pergola support attachment is shown in the cross-sectional view of FIG. 4. In FIG. 4 header beam 322 is situated within angle plate 302 so as the horizontal side 304 of angle plate 302 bears the weight of header beam 322 and the vertical side 303 of angle plate 302 is secured to header beam 322 with one or more lag screws 320 that are placed through holes 370 on vertical side 303. Header beam 322 may be a 4 inch by 8 inch header beam made of appropriate wood to withstand the elements, such as cedar. Lag screws 320 may be 3.5 inches in length and ⅜ inch diameter to secure angle plate 302 to header beam 322.

Continuing with FIG. 4, tubular sleeve 306 is slidably engaged about base tube 308 until horizontal side 304 of angle plate 302 prevents further insertion of base tube 308 within tubular sleeve 306. Hole pairs 307 on tubular sleeve 306 and hole pairs 309 on base tube 308 are located according to the height of tubular sleeve 306 such that the hole pairs are aligned when base tube 308 is fully inserted within tubular sleeve 306. In this manner, bolt 330 may be inserted through the aligned hole pairs and secured with an appropriately sized nut. Base plate 310, which is welded or otherwise fastened to the bottom end of base tube 308 fastened to the top wall plate 332 of a 3.5 inch exterior home wall via a lag screw 340 inserted through base plate hole 312 at the center of the base plate and welded to base plate 310. The top plate of the exterior home wall to which the pergola support attachment is affixed, in one embodiment, is one or more 2 inch by 4 inch spans of lumber, i.e., a "2×4" commonly used in home construction or for porch beams.

Figure 6:
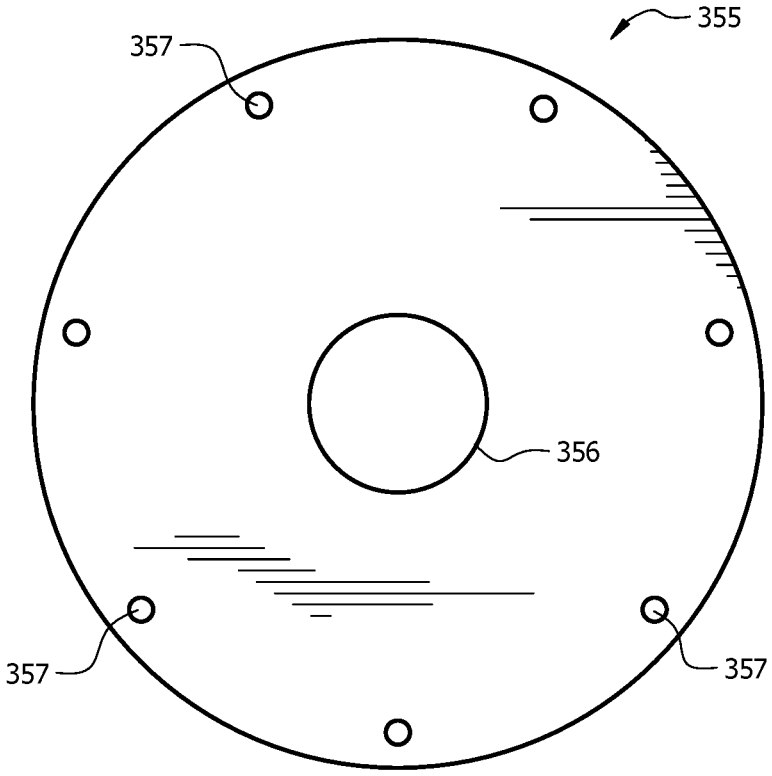
FIG. 6 is a top view of a deck collar according to an embodiment of the present disclosure.

As seen in FIG. 4, base tube 308 passes through the upper surface, such as shingles and sub-surface of roof 104 in order to interface with top wall plate 332 via base plate 310. Thus, an opening must be made in roof 104 to accommodate base tube 308 and the diameter of base plate 310. In order to prevent water from entering the home via this hole in roof 104, a device such as a commercially available vent stack boot 350 is placed around base tube 308 prior to full assembly and installation of pergola support attachment 300. Vent stack boot 350 slides over base tube 308 and covers deck collar 355. Deck collar 355 is depicted in FIG. 6. Deck collar 355 can be circular in shape and have substantially the same footprint as vent stack boot 350. Deck collar 355 includes a center hole 356 that is of sufficient diameter to receive base tube 308, which has a slightly smaller diameter. In embodiment, center hole 358 is of a 2⅛ inch diameter, but can be various sizes to accommodate base tubes of different diameters. Deck collar 355 also includes a series of holes 357 situated near the perimeter of deck collar 355. Through these holes are inserted fasteners, such as screws, to fasten deck collar 355 to roof surface 104 to prevent base tube 308 from moving.

Returning to FIG. 4, Vent stack boot 350 is round in one embodiment and is angled at its base to securely interface with the pitch of roof 104 with nails into the decking. Vent stack boot 350 can have a circumference sufficient to cover the opening in roof 104 to receive base tube 308 in order to prevent roof leaks. Vent stack boot 350 is commonly available and includes a base flange having a plurality of apertures through which screws or nails be inserted to secure vent stack boot 350 to the roof's sub-surface. Once vent stack boot 350 is fastened to the roof, the base flange of vent stack boot 350 may be covered with shingles to further cover the opening for base tube 308. In this manner, pergola support attachment 300, and in particular base tube 308 and base plate 310 are unobtrusively installed. Base tube 308 and base plate 310 can be installed during new construction of a roof in anticipation of pergola or similar structure installation in which direct roof connection in the traditional sense would occur. The visible portion of base tube 308 is similar to a vent stack commonly found on a home roof. A vacant base tube 308 of the presently described pergola support attachment, therefore, does not appear out of place on the home.

Figure 5:
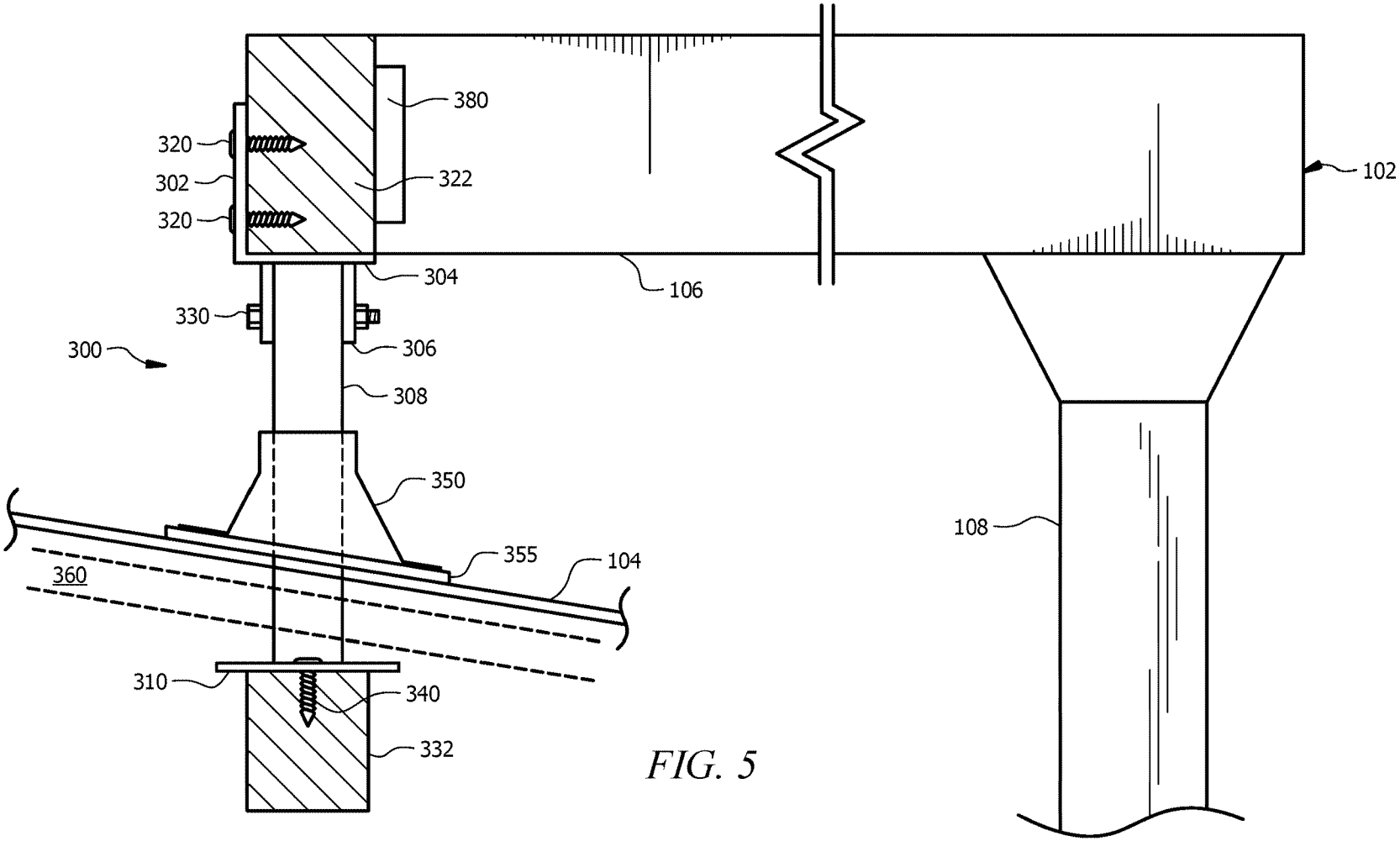
FIG. 5 is a side view of an installed pergola support according to an embodiment of the present disclosure.

FIG. 5 is a side view of an installed pergola support attachment 300 with the rafters 106 of pergola 102 affixed to header beam 322 that is fastened to angle plate 302 of pergola support attachment 300. Pergola rafter 106 can be directly fastened to header beam 322 with screws or nails. In an alternative embodiment, a joist hanger 360 may be installed on the end of pergola rafter 106 and fixed to header beam 322 to allow ease in hanging and affixing pergola rafter 106 to header beam 322. The base plate 310 is secured to header beam or wall cap 332 by turning base tube 308 with a pipe wrench or other suitable turning means. Rotating base tube 308 in a clockwise direction causes lag screw 340 welded to base plate 310 to penetrate header beam or wall cap 332, thereby securing base plate 310. As described the presently disclosed pergola support attachment provides a secure connection assembly on the roof for pergola rafter attachment that is superior in strength to traditional direct roof sub-surface attachment of pergola rafters. Moreover, the pergola support attachment prevents damage or compromise of roofing materials when penetrated by nails or screws due to direct roof installation. The vented stack boot prevent leakage at the point of entry of the base tube of the pergola support attachment and the pergola to roof interface that lies at the pergola support attachment can be left undisturbed if roof shingles or the roof sub-surface need replacement.

Figure 7:
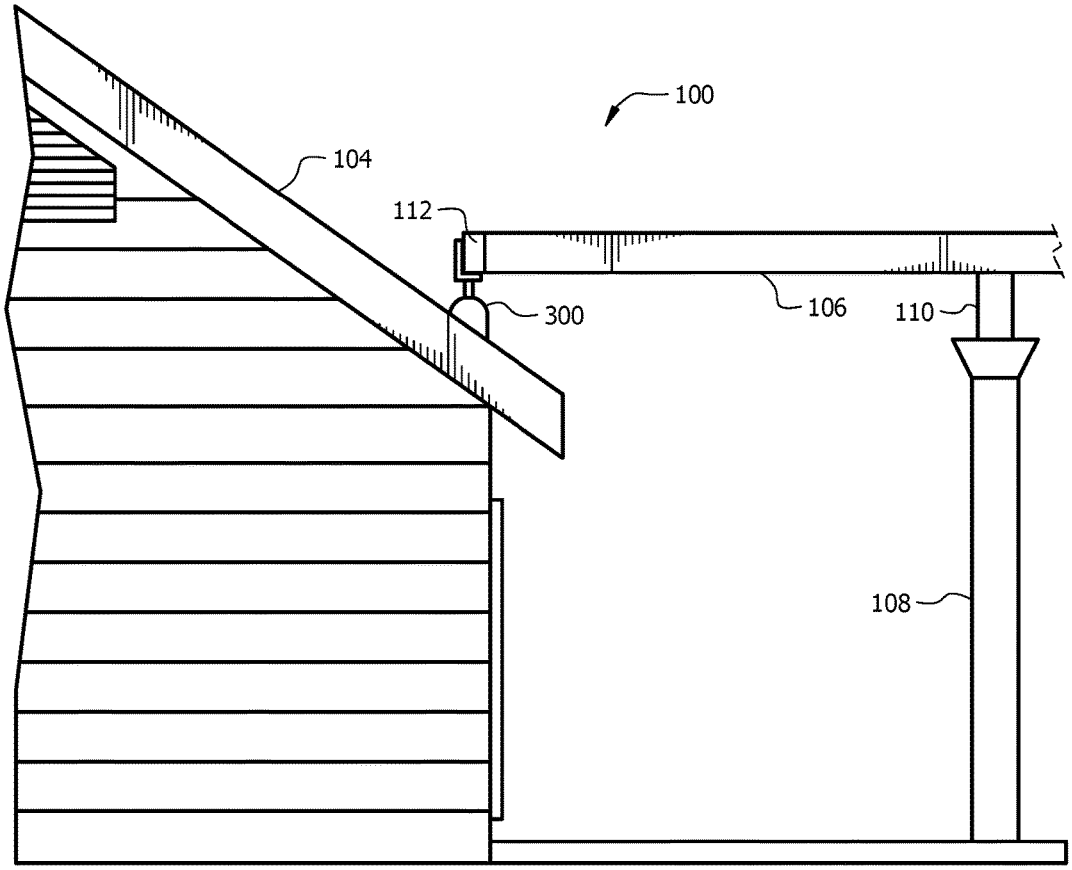
FIG. 7 is a perspective view of a pergola structure attached to a roof with an embodiment of the present disclosure.

FIG. 7 is a perspective view of pergola support attachment 300 as installed on a pergola structure. As seen, pergola rafter 106 is attached to beam 112 (see 322 in FIG. 5) positioned perpendicular to pergola rafters 106. Beam 112 is affixed to pergola support attachment 300 at L-shaped angle plate 302 (see FIG. 5). At the other end of pergola rafter 106, beam 110 may be inserted between post 108 and rafter 106 to accommodate for the increased height of the structure after installation of pergola support attachment 300, or a longer post 108 may simply be installed. With the presently described pergola support attachment, pergola rafters are no longer installed directly on roof 104, eliminating damage to roof 104 is pergola replacement occurs or damage to the pergola is roof replacement is required.

The foregoing description is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

While the disclosed embodiments have been described with reference to one or more particular implementations, these implementations are not intended to limit or restrict the scope or applicability of the invention. Those having ordinary skill in the art will recognize that many modifications and alterations to the disclosed embodiments are available. Therefore, each of the foregoing embodiments and obvious variants thereof is contemplated as falling within the spirit and scope of the disclosed inventions.

While the invention has been particularly shown and described with reference to a preferred embodiment, it will be understood by those skilled in the art that various changes in form and detail can be made therein without departing from the spirit and scope of the invention.

What is claimed is:

1. A roofing structure support apparatus, comprising:

a base tube;

a first plate secured to an upper end of the base tube;

a second plate secured to a lower end of the base tube;

a collar having a first opening configured to receive the base tube;

a boot having a second opening corresponding to the first opening of the collar for receipt of the base tube;

wherein the collar includes a plurality of fastening apertures configured to receive fasteners to secure the collar to a roof deck, wherein the lower end of the base tube extends below the collar and through the roof deck, and wherein the lower end of the base tube penetrates a roof deck opening having a size substantially similar to the first opening and the second opening.

2. The roofing structure support apparatus of claim 1, wherein the first plate is secured perpendicularly to the upper end of the base tube.

3. The roofing structure support apparatus of claim 1, wherein the second plate is secured perpendicularly to the lower end of the base tube.

4. The roofing structure support apparatus of claim 1, further comprising a tubular sleeve in communication with the first plate for securing the first plate to the upper end of the base tube.

5. The roofing structure support apparatus of claim 1, wherein the base tube is cylindrical.

6. The roofing structure support apparatus of claim 1, wherein the base tube is rectangular.

7. The roofing structure support apparatus of claim 1, wherein the base tube has a diameter of approximately two inches.

8. The roofing structure support apparatus of claim 1, wherein the first plate has a thickness of approximately three-sixteenths of an inch.

9. The roofing structure support apparatus of claim 1, wherein the second plate has a thickness of approximately three-sixteenths of an inch.

10. The roofing structure support apparatus of claim 1, wherein the first plate is substantially L-shaped.

11. The roofing structure support apparatus of claim 10, wherein a vertical extension of the L-shaped plate includes at least one bore hole for receipt of a joist fastener for securing the L-shaped plate to a joist.

12. The roofing structure support apparatus of claim 1, wherein the first opening is an annular opening.

13. The roofing structure support apparatus of claim 12, wherein the second opening is an annular opening.

14. The roofing structure support apparatus of claim 1, wherein the second plate is circular.

15. The roofing structure support apparatus of claim 14, wherein the second plate is approximately three and one-half inches in diameter.

16. The roofing structure support apparatus of claim 1, wherein the second plate is rectangular.

17. The roofing structure support apparatus of claim 16, wherein the second plate is a square plate having sides of approximately four-inches each.

* * * * *